US006655113B2

(12) United States Patent
Salicini et al.

(10) Patent No.: US 6,655,113 B2
(45) Date of Patent: Dec. 2, 2003

(54) METHOD AND UNIT FOR WRAPPING SWEETS

(75) Inventors: Sandro Salicini, Monterenzio (IT); Stefano Cavallari, Bologna (IT)

(73) Assignee: Azionaria Costruzioni Macchine Automatiche A.C.M.A. S.p.A., Bologna (IT)

( * ) Notice: Subject to any disclaimer, the term of this patent is extended or adjusted under 35 U.S.C. 154(b) by 0 days.

(21) Appl. No.: 10/193,698

(22) Filed: Jul. 11, 2002

(65) Prior Publication Data

US 2003/0033787 A1 Feb. 20, 2003

(30) Foreign Application Priority Data

Jul. 13, 2001 (IT) ..... BO2001A0440

(51) Int. Cl.[7] ..... B65B 49/00
(52) U.S. Cl. ..... 53/461
(58) Field of Search ..... 53/466, 225, 227, 53/234

(56) References Cited

U.S. PATENT DOCUMENTS 2,744,370 A * 5/1956 Seragnoli ..... 53/227
3,797,198 A * 3/1974 Fukuzaki ..... 53/227
3,890,766 A * 6/1975 Hatta ..... 53/234
3,899,865 A * 8/1975 Revaz ..... 53/225
3,977,159 A * 8/1976 Seragnoli ..... 53/234
4,351,142 A * 9/1982 Focke et al. ..... 53/575
4,352,265 A * 10/1982 Hansel et al. ..... 53/234
4,636,186 A * 1/1987 Focke et al. ..... 53/234
5,133,173 A * 7/1992 Draghetti et al. ..... 53/466

FOREIGN PATENT DOCUMENTS

GB 754741 8/1956
GB 943495 12/1963

* cited by examiner

*Primary Examiner*—John Sipos
(74) *Attorney, Agent, or Firm*—Ladas & Parry

(57) ABSTRACT

A method and unit for wrapping sweets, whereby a sweet, housed in a relative first peripheral seat of a distribution plate rotating about a first axis, is extracted from the relative first seat in an extraction direction parallel to the first axis, and is then fed to a relative second seat of a wrapping wheel, rotating about a second axis crosswise to the first axis, in a feed direction substantially crosswise to the extraction direction and through a feed line parallel to the first axis and for supplying sheets of wrapping material.

18 Claims, 3 Drawing Sheets

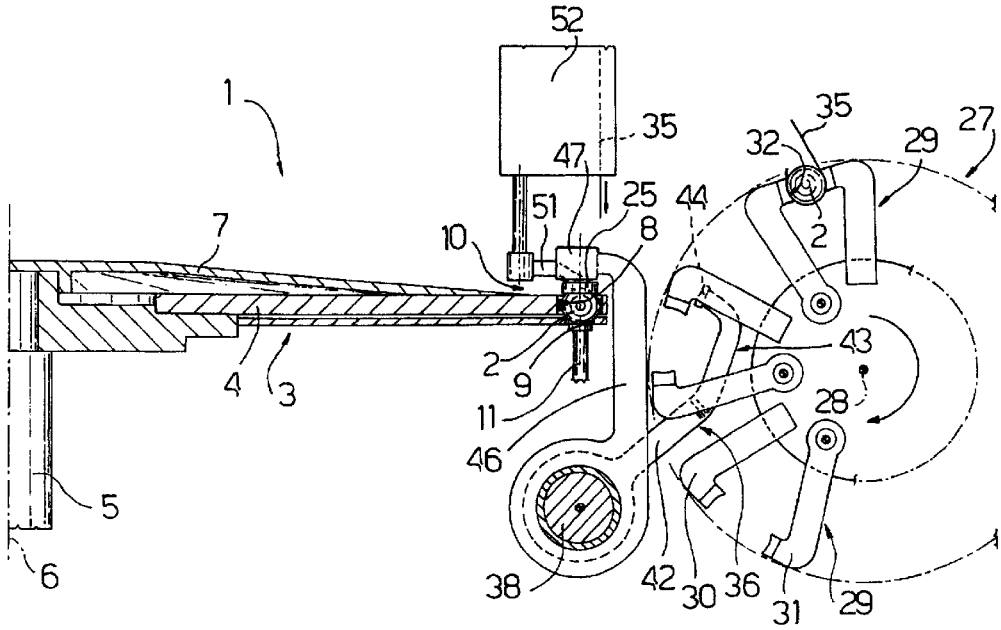
Fig. 2
Fig. 3
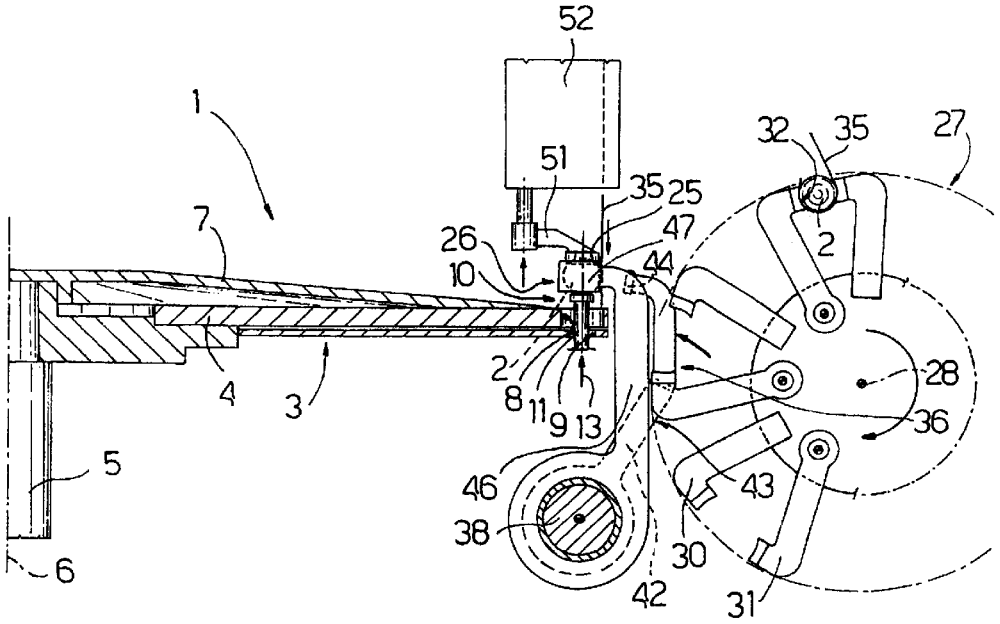

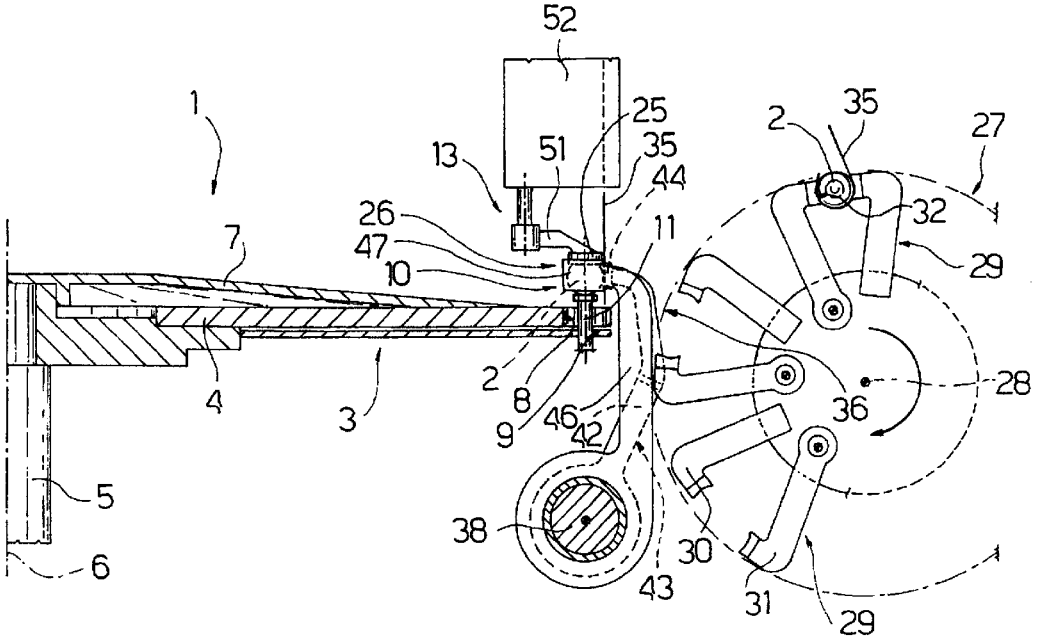
Fig. 4
Fig. 5
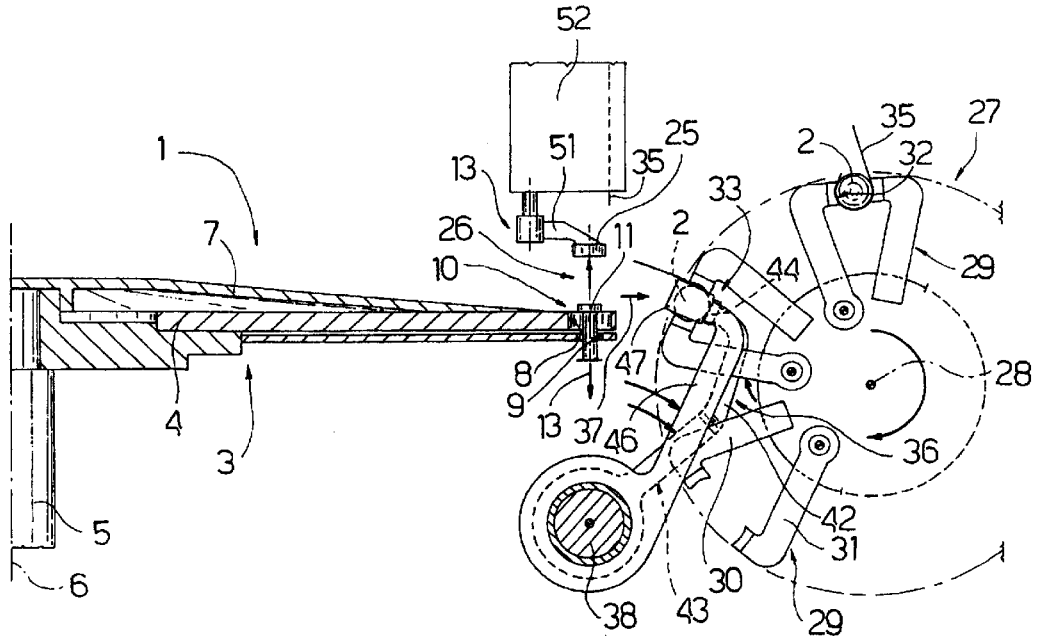

METHOD AND UNIT FOR WRAPPING SWEETS

The present invention relates to a method of wrapping sweets and similar.

More specifically, the present invention relates to a method of wrapping sweets, the method being of the type comprising the steps of loading the sweets in bulk onto a distribution plate having a number of first peripheral seats, each for receiving a respective sweet; rotating said distribution plate about a first axis to feed said sweets into the relative said first seats, and to feed the sweets successively through an extracting station; successively extracting said sweets from the relative said first seats at said extracting station and in an extraction direction substantially parallel to said first axis; and successively feeding said sweets through a feed line, for supplying respective sheets of wrapping material, and into respective second seats on a wrapping wheel rotating about a second axis perpendicular to said first axis.

BACKGROUND OF THE INVENTION

In sweet wrapping units implementing the above method, the wrapping wheel is normally mounted over the distribution plate, and each sweet extracted from the relative first seat in said extraction direction—normally a vertical direction—continues in the same direction through the wrapping material sheet feed line—normally a horizontal feed line—and is inserted into the relative second seat on the wrapping wheel, together with the relative sheet of wrapping material, which, during insertion, is gradually folded into a U.

The above method normally has various functional and structural drawbacks. Firstly, transferring each sweet from the relative first seat to the relative second seat, normally by means of a pusher, the operating time of the pusher is such as to prevent the distribution plate from being operated continuously. Secondly, feeding the sheets of wrapping material along a horizontal feed line normally calls for using relatively complicated, high-cost supporting and feed devices. And finally, location of the wrapping wheel over the distribution plate impedes both access to the distribution plate itself, and any maintenance of the wrapping unit as a whole.

SUMMARY OF THE INVENTION

It is an object of the present invention to provide a method of wrapping sweets, designed to eliminate the aforementioned drawbacks.

According to the present invention, there is provided a method of wrapping sweets, the method comprising the steps of loading sweets in bulk onto a distribution plate having a number of first peripheral seats, each for receiving a respective sweet; rotating said distribution plate about a first axis to feed said sweets into the relative said first seats, and to feed the sweets successively through an extracting station; successively extracting said sweets from the relative said first seats at said extracting station and in an extraction direction substantially parallel to said first axis; and successively feeding said sweets through a feed line, for supplying respective sheets of wrapping material, and into respective second seats on a wrapping wheel rotating about a second axis crosswise to said first axis; and being characterized in that said sweets are fed through said feed line and into the relative said second seats in a feed direction substantially perpendicular to said extraction direction and preferably substantially radial with respect to said first and said second axis.

In other words, in the above method, each sweet is fed from the relative first seat on the distribution plate into the relative second seat on the wrapping wheel along a path which, as opposed to being straight, is defined by two portions: a first extending in an axial direction with respect to the distribution plate, and a second extending in a substantially crosswise direction through the wrapping material sheet feed line. This has the threefold advantage of minimizing the length of the first portion, and therefore the operating time of a pusher, if any, so that the distribution plate can be operated substantially continuously; locating the wrapping material sheet feed line parallel to the axis of the distribution plate, thus affording considerable mechanical and cost advantages; and locating the wrapping wheel alongside, as opposed to over, the distribution plate.

The present invention also relates to a unit for wrapping sweets.

According to the present invention, there is provided a unit for wrapping sweets, the unit comprising a distribution plate mounted to rotate about a first axis, the distribution plate receiving sweets in bulk and having a number of first peripheral seats, each for receiving a respective sweet and for feeding the sweet through an extracting station; a wrapping wheel rotating about a second axis crosswise to said first axis, and having a number of second seats for receiving respective said sweets; a feed line for supplying sheets of wrapping material in which to wrap said sweets, said feed line being interposed between said distribution plate and said wrapping wheel; and extracting means located at said extracting station and movable with respect to said distribution plate to extract said sweets successively from the relative said first seats in an extraction direction substantially parallel to said first axis; the unit being characterized by also comprising feed means for receiving said sweets successively from said extracting means, and for feeding the sweets successively through said feed line and into respective said second seats in a feed direction substantially perpendicular to said extraction direction and preferably substantially radial with respect to said first and said second axis.

BRIEF DESCRIPTION OF THE DRAWINGS

A non-limiting embodiment of the present invention will be described by way of example with reference to the accompanying drawings, in which:

FIGS. 2 to 5 show schematic sections of the FIG. 1 unit in four different operating positions.

DETAILED DESCRIPTION OF THE INVENTION

Figure 1:
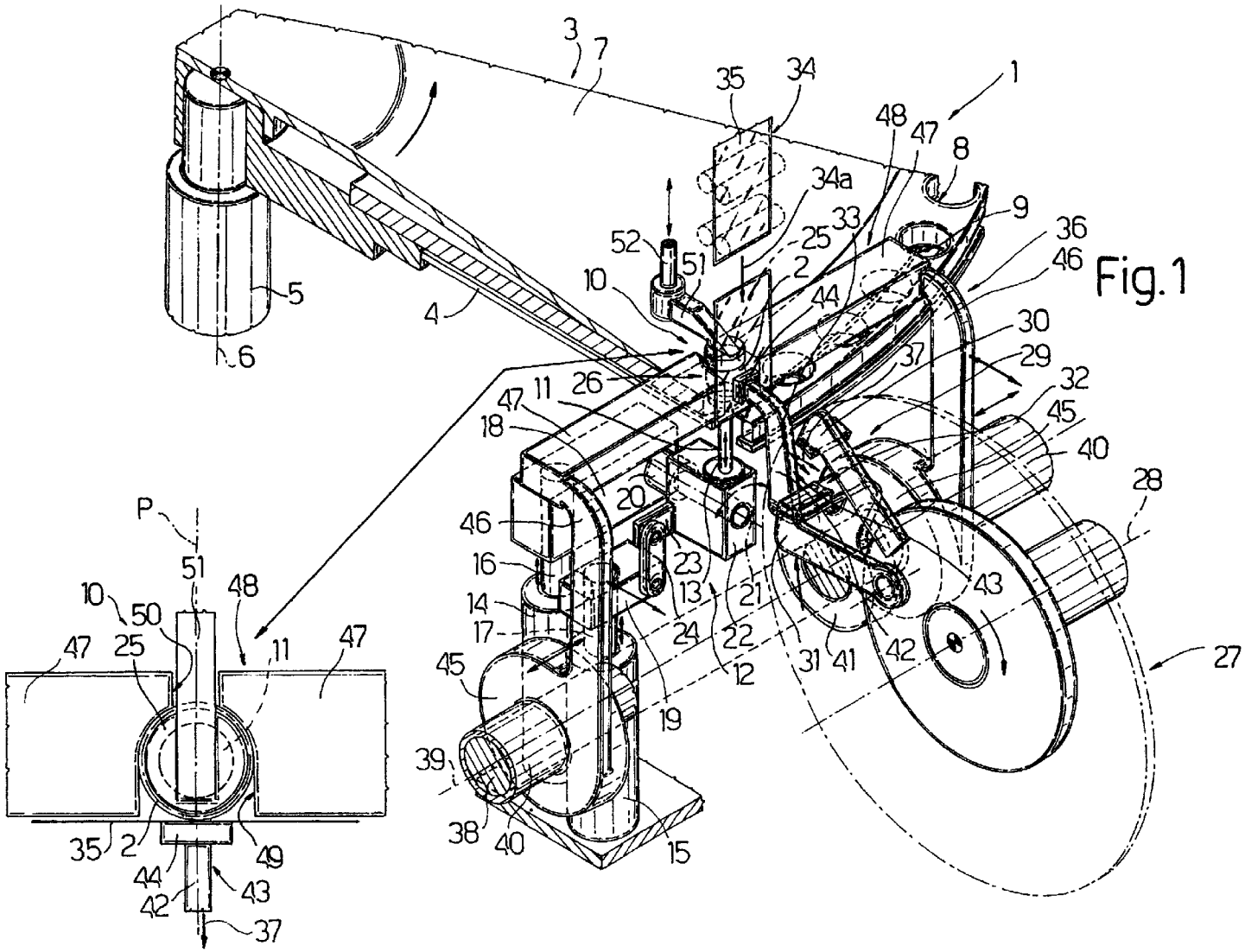
FIG. 1 shows a view in perspective, with parts in section and parts removed for clarity, of a preferred embodiment of the wrapping unit according to the present invention.

Number 1 in FIG. 1 indicates as a whole a wrapping unit for wrapping sweets 2 and comprising a distribution plate 3, in turn comprising a disk 4, which is fitted to a powered shaft 5 to rotate, anticlockwise in FIG. 1, about a vertical axis 6, and supports a coaxial truncated-cone-shaped plate 7 positioned with its concavity facing downwards, and having, on its outer periphery, a succession of substantially circular through seats 8. Each seat 8 is designed to receive a respective sweet 2, which is retained inside seat 8 by disk 4, which, at seats 8, has a circular opening 9 coaxial with axis 6 and smaller in width than the diameter of seats 8.

As it rotates about axis 6, each seat 8 is fed by distribution plate 3 through an extracting station 10, where each sweet 2 is engaged by a pusher 11 of an extracting assembly 12 and extracted from relative seat 8 upwards in an extraction direction 13 substantially parallel to axis 6.

Extracting assembly 12 comprises two actuators 14 and 15, which are fitted to a fixed plate located beneath disk 4 and alongside extracting station 10, and comprise respective top output rods 16 and 17 parallel to axis 6 and fitted on their free ends with respective parallel cross members 18 and 19 facing extracting station 10 and perpendicular to respective rods 16 and 17. Cross member 18 is located closer to disk 4 than cross member 19, and is fitted, close to its free end facing extracting station 10, with a pin 20, the axis 21 of which extends in a substantially radial direction with respect to axis 6. Pin 20 is fitted idly with a rectangular parallelepiped-shaped head 22, the longitudinal axis of which is substantially coincident with axis 21, and a lateral surface of which is connected to the bottom end of pusher 11, which extends upwards from head 22 in a radial direction with respect to axis 21. An appendix 23 projects laterally from head 22 towards cross member 19, is perpendicular to axis 21 and to pusher 11, and is connected to the free end of cross member 19 by a connecting rod 24 hinged to appendix 23 and to cross member 19 to rotate, with respect to appendix 23 and cross member 19, about respective axes parallel to axis 21.

Pusher 11 is aligned with the portion of opening 9 located at each instant at extracting station 10, and faces a counter-pusher 25 forming part of extracting assembly 12, and which is located over truncated-cone-shaped plate 7 at extracting station 10, and moves back and forth in extraction direction 13. Counter-pusher 25 cooperates with pusher 11 to extract a sweet 2 from a relative seat 8 at extracting station 10, and move sweet 2 upwards in extraction direction 13 into a pickup position 26 shown in FIGS. 1, 3 and 4.

In addition to distribution plate 3 and extracting assembly 12, wrapping unit 1 also comprises a wrapping wheel 27 located alongside distribution plate 3 and mounted to rotate in steps about an axis 28 crosswise to axis 6 and extending outside the outer periphery of distribution plate 3, just below the plane of disk 4. Wrapping wheel 27 comprises a number of peripheral grippers 29, which move with wrapping wheel 27 in a plane P substantially radial with respect to distribution plate 3 and through extracting station 10 and pickup position 26, and each of which comprises a fixed jaw 30, and a movable jaw 31 located upstream from relative fixed jaw 30 in the rotation direction (clockwise in FIG. 1) of wrapping wheel 27 about axis 28. Each movable jaw 31 is fitted to wrapping wheel 27 to rotate towards the relative fixed jaw 30 about a relative axis parallel to axis 28 and by means of a known cam control device (not shown), so as to define, with relative fixed jaw 30, a relative conveying seat 32 for a relative sweet 2 when relative gripper 29 is moved by wrapping wheel 27 into a loading position 33 lying in plane P and facing extracting station 10.

Wrapping unit 1 also comprises, between distribution plate 3 and wrapping wheel 27, a feed line 34 for supplying a succession of sheets 35 of wrapping material in which to wrap sweets 2; and a transfer assembly 36 for transferring sweets 2 successively—in a feed direction 37 parallel to plane P, substantially radial with respect to axes 6 and 28, and substantially perpendicular to extraction direction 13—from pickup position 26 to a respective conveying seat 32 in loading position 33.

Feed line 34 extends downwards, adjacent to pickup position 26, and through extracting station 10 in a feed direction 34*a* parallel to axis 6, so as to feed a sheet 35 of wrapping material into an end position, in which sheet 35 of wrapping material is positioned between counter-pusher 25 and transfer assembly 36, and with an intermediate portion at pickup position 26.

Transfer assembly 36 comprises a shaft 38 powered by a known cam device (not shown) to oscillate about an axis 39 extending parallel to axis 28, beneath disk 4, and between wrapping wheel 27 and actuators 14 and 15; and two tubular shafts 40 coaxial with each other and with shaft 38, and powered by a known cam device (not shown) to oscillate about axis 39 independently of shaft 38, and to slide axially along shaft 38 between a parted rest position and a mating work position for the reasons and as explained in detail later on.

Shaft 38 is fitted with a ring 41, from which extends outwards the arm 42 of a pressure member 43, an end head 44 of which is movable with ring 41 between pickup position 26 and loading position 33. Each of the two tubular shafts 40 is fitted with a ring 45, from which extends outwards an arm 46 fitted on its free end with a block 47 perpendicular to plane P and coaxial with the other block 47. The two blocks 47 are located on opposite sides of plane P, and, together with relative arms 46, define respective jaws of a gripping device 48. At their respective free ends, the two blocks 47 have respective cavities facing wrapping wheel 27 and defining, when tubular shafts 40 are in the mating position, a movable seat 49 open towards wrapping wheel 27 and for receiving a sweet 2 from a corresponding seat 8 at extracting station 10, and for transferring the sweet 2 into loading position 33.

When tubular shafts 40 are in the mating position, the free ends of the two blocks 47 are separated by a distance (FIG. 1) sufficient to define, between blocks 47, a passage 50 for an arm 51, which extends in plane P and radially with respect to axis 6, is moved back and forth in plane P and parallel to extraction direction 13 by an actuating member 52, and supports counter-pusher 25. Conversely, when tubular shafts 40 are in the parted position (not shown), the free ends of blocks 47 are separated by a distance greater than the width of a sheet 35 of wrapping material.

Operation of wrapping unit 1 will now be described, relative to one sweet 2 and with reference to FIGS. 2 to 5, as of the instant (FIG. 2) in which a sweet 2, fed in bulk onto truncated-cone-shaped plate 7 together with the other sweets 2 not shown, is fed, by distribution plate 3 rotating continuously about axis 6, into a relative seat 8 and then by relative seat 8 to extracting station 10.

In extracting assembly 12, equal axial displacement in the same direction of rods 16 and 17 of actuators 14 and 15 corresponds to upward or downward axial displacement of pusher 11; while unequal displacements of rods 16 and 17 correspond to displacement of pusher 11 in the displacement direction of rod 16, and rotation of pusher 11 clockwise or anticlockwise in FIG. 1 about axis 21, depending on whether displacement of rod 17 is greater or less than that of rod 16.

As the full seat 8 in question nears extracting station 10, pusher 11 is raised from the lowered position and, at the same time, rotated anticlockwise to engage opening 9 in disk 4 and contact sweet 2 (FIG. 2), which is also contacted by counter-pusher 25 moving down. Pusher 11 is then raised further, together with counter-pusher 25, to engage seat 8 and feed sweet 2 in extracting direction 13 to pickup position 26 and into movable seat 49 (FIG. 3) defined by gripping device 48 already moved into extracting station 10. As it is raised further as described above, pusher 11 is rotated clockwise (in FIG. 1) about axis 21 to accompany the displacement of seat 8 caused by distribution plate 3 rotating continuously about axis 6.

At the same time, a sheet 35 of wrapping material is fed to extracting station 10 into a position facing movable seat 49, and pressure member 43 is moved to pickup position 26 (FIGS. 3 and 4), on the opposite side of sheet 35 of wrapping material with respect to movable seat 49, so that head 44 presses an intermediate portion of sheet 35 of wrapping material onto sweet 2 at pickup position 26, and presses sweet 2 inside movable seat 49. At this point, counter-pusher 25 is raised (FIG. 5), and pusher 11 is lowered and simultaneously rotated (clockwise in FIG. 1) further about axis 21 to release seat 8 while at the same time accompanying it as it rotates continuously about axis 6. At the same time, gripping device 48 and pressure member 43 are rotated in unison (FIG. 5) clockwise about axis 39 to feed sweet 2 and relative sheet 35 of wrapping material in feed direction 37 from pickup position 26 to loading position 33 and into the conveying seat 32 defined by a gripper 29 arrested in the open position at loading position 33 to receive sweet 2 and simultaneously fold relative sheet 35 of wrapping material into a U about sweet 2. Gripper 29 is then closed about sweet 2 and relative sheet 35 of wrapping material, so that gripping device 48 is free to return to extracting station 10 (FIG. 2), whereas pressure member 43, before it can return to pickup position 26, must wait for wrapping wheel 27 to move forward one step (FIG. 3).

As gripping device 48 moves to pickup position 26, the two blocks 47 are parted to avoid interfering with the next sheet 35 of wrapping material fed to extracting station 10 along feed line 34.

What is claimed is:

1. A method of wrapping sweets (2), the method comprising the steps of loading sweets (2) in bulk onto a distribution plate (3) having a number of first peripheral seats (8), each for receiving a respective sweet (2); rotating said distribution plate (3) about a first axis (6) to feed said sweets (2) into the relative said first seats (8), and to feed the sweets (2) successively through an extracting station (10); successively extracting said sweets (2) from the relative said first seats (8) at said extracting station (10) and in an extraction direction (13) substantially parallel to said first axis (6); and successively feeding said sweets (2) through a feed line (34), for supplying respective sheets (35) of wrapping material, and into respective second seats (32) on a wrapping wheel (27) rotating about a second axis (28) crosswise to said first axis (6); and being characterized in that said sweets (2) are fed through said feed line (34) and into the relative said second seats (32) in a feed direction (37) substantially perpendicular to said extraction direction (13).

2. A method as claimed in claim 1, characterized in that said feed direction (37) is a substantially radial direction with respect to said first and said second axis (6, 28).

3. A method as claimed in claim 1, characterized in that said feed line (34) extends parallel to said first axis (6).

4. A method as claimed in claim 1, characterized in that said first axis (6) is a vertical axis.

5. A method as claimed in claim 1, characterized by comprising the further steps of feeding, in said extraction direction (13), each said sweet (2) extracted from the relative said first seat (8) to a pickup position (26) adjacent to said feed line (34), and into a movable seat (49) of a transfer assembly (36) interposed between said distribution plate (3) and said wrapping wheel (27); and pairing each said sweet (2) at said pickup position (26) with a relative said sheet (35) of wrapping material; said transfer assembly (36) moving said movable seat (49), in said feed direction (37) and through said feed line (34), between said pickup position (26) and a said second seat (32) located at a given loading position (33).

6. A method as claimed in claim 5, characterized in that said movable seat (49) is defined by movable jaws (47) of a gripping device (48) of said transfer assembly (36), and is open towards said wrapping wheel (27); each said sweet (2) being retained inside said movable seat (49) by a pressure member (43) movable with said movable seat (49) from said pickup position (26) to said loading position (33); and said gripping device (48) and said pressure member (43) being located on opposite sides of said feed line (34) when said movable seat (49) is located at said pickup position (26).

7. A method as claimed in claim 1, characterized in that said distribution plate (3) is rotated substantially continuously about said first axis (6); each sweet (2) being extracted from the relative said first seat (8) in said extraction direction (13) and at said extracting station (10) by means of a pusher (11) moving back and forth in said extraction direction (13) through said first seat (8); said pusher (11) being rotated about a third axis (21) radial with respect to said first axis (6) to accompany said first seat (8) as the first seat moves continuously about said first axis (6).

8. A unit for wrapping sweets (2), the unit comprising a distribution plate (3) mounted to rotate about a first axis (6), the distribution plate (3) receiving sweets (2) in bulk and having a number of first peripheral seats (8), each for receiving a respective sweet (2) and for feeding the sweet (2) through an extracting station (10); a wrapping wheel (27) rotating about a second axis (28) crosswise to said first axis (6), and having a number of second seats (32) for receiving respective said sweets (2); a feed line (34) for supplying sheets (35) of wrapping material in which to wrap said sweets (2), said feed line (34) being interposed between said distribution plate (3) and said wrapping wheel (27); and extracting means (12) located at said extracting station (10) and movable with respect to said distribution plate (3) to extract said sweets (2) successively from the relative said first seats (8) in an extraction direction (13) substantially parallel to said first axis (6); the unit (1) being characterized by also comprising feed means (36) for receiving said sweets (2) successively from said extracting means (12), and for feeding the sweets (2) successively through said feed line (34) and into respective said second seats (32) in a feed direction (37) substantially perpendicular to said extraction direction (13).

9. A unit as claimed in claim 8, characterized in that said feed direction (37) is a substantially radial direction with respect to said first and said second axis (6, 28).

10. A unit as claimed in claim 8, characterized in that said feed line (34) extends parallel to said first axis (6).

11. A unit as claimed in claim 8, characterized in that said first axis (6) is a vertical axis.

12. A unit as claimed in claim 8, characterized in that said feed means (36) comprise a gripping device (48) in turn comprising two jaws (47) movable with respect to each other to and from a closed position wherein the two jaws (47) define a movable seat (49) for receiving a said sweet (2) from said extracting means (12), said movable seat (49) being open towards said wrapping wheel (27); and a pressure member (43) for retaining said sweet (2) inside said movable seat (49); said gripping device (48) and said pressure member (43) being movable, in said feed direction (37), between a pickup position (26), at which said sweet (2) is picked up by said extracting means (12), and a loading position (33), at which said sweet (2) is loaded into a respective said second seat (32).

13. A unit as claimed in claim 12, characterized in that said gripping device (48) and said pressure member (43) are located on opposite sides of said feed line (34) when said movable seat (49) is located at said pickup position (26).

14. A unit as claimed in claim 12, characterized in that said jaws (47) of said gripping device (48) are movable with respect to each other in a direction parallel to said second axis (28).

15. A unit as claimed in claim 12, characterized in that said gripping device (48) and said pressure member (43) are mounted to rotate about an axis (39) of rotation parallel to said second axis (28).

16. A unit as claimed in claim 12, characterized in that said gripping device (48) and said pressure member (43) are mounted to rotate independently about the same axis (39) of rotation parallel to said second axis (28).

17. A unit as claimed in claim 8, characterized by comprising continuous drive means (5) for said distribution plate (3); said extracting means (12) comprising a pusher (11), and actuating means (14–24) by which said pusher (11) is moved back and forth in said extraction direction (13) through a said first seat (8) moving continuously, in use, through said extracting station (10), and is also rotated about a third axis (21), radial with respect to said first axis (6), to accompany said first seat (8) as the first seat moves continuously through said extracting station (10).

18. A unit as claimed in claim 17, characterized in that said actuating means (14-24) comprise a first and a second cross member (18, 19) parallel to said second axis (28); first and second actuating means (14, 15) for respectively moving said first (18) and said second (19) cross member in a direction parallel to said first axis (6); a head (22) supporting said pusher (11) and fitted to said first cross member (18) to rotate with respect to the first cross member (18) about said third axis (21); and connecting-rod means (24) for connecting said head (22) to said second cross member (19).

* * * * *